US008314321B2

(12) United States Patent
Wun et al.

(10) Patent No.: US 8,314,321 B2
(45) Date of Patent: Nov. 20, 2012

(54) APPARATUS AND METHOD FOR TRANSFORMING AN INPUT SOUND SIGNAL

(75) Inventors: Cheuk Wai Simon Wun, Singapore (SG); Ti Eu Chan, Singapore (SG); Chern Han Yong, Singapore (SG)

(73) Assignee: Agency For Science, Technology And Research, Connexis (SG)

( * ) Notice: Subject to any disclaimer, the term of this patent is extended or adjusted under 35 U.S.C. 154(b) by 0 days.

(21) Appl. No.: 12/678,935

(22) PCT Filed: Sep. 19, 2007

(86) PCT No.: PCT/SG2007/000319

§ 371 (c)(1),
(2), (4) Date: Oct. 12, 2010

(87) PCT Pub. No.: WO2009/038539

PCT Pub. Date: Mar. 26, 2009

(65) Prior Publication Data

US 2011/0023692 A1 Feb. 3, 2011

(51) Int. Cl.
*G10H 1/00* (2006.01)

(52) U.S. Cl. ..... 84/615

(58) Field of Classification Search ..... 84/615
See application file for complete search history.

(56) References Cited

U.S. PATENT DOCUMENTS

| | | | | |
|---|---|---|---|---|
| 5,512,704 | A * | 4/1996 | Adachi | 84/605 |
| 6,011,212 | A * | 1/2000 | Rigopulos et al. | 84/667 |
| 6,025,552 | A | 2/2000 | Mukaino et al. | |
| 6,150,598 | A * | 11/2000 | Suzuki et al. | 84/603 |
| 7,041,892 | B2 | 5/2006 | Becker | |
| 2001/0017076 | A1 * | 8/2001 | Fujita et al. | 84/603 |

OTHER PUBLICATIONS

International Search Report corresponding to PCT/SG2007/000319, Nov. 26, 2007, 3 pages.
PCT Written Opinion corresponding to PCT/SG2007/000319, Nov. 26, 2007, 3 pages.

* cited by examiner

*Primary Examiner* — Jianchun Qin
(74) *Attorney, Agent, or Firm* — Foley & Lardner LLP

(57) ABSTRACT

An apparatus for transforming an input sound signal includes a synthesiser which manipulates, in accordance with a manipulation parameter, a pitch deviation envelope to derive a manipulated pitch deviation envelope. A filter transforms the input sound signal from a resampling of the input sound signal with respect to the manipulated pitch deviation envelope. The manipulation parameter may be a user-defined peak pitch deviation of an output sound signal. Another apparatus for transforming an input sound signal includes a synthesiser which manipulates, in accordance with a manipulation parameter, a pitch deviation envelope selected with reference to the manipulation parameter to derive a manipulated pitch deviation envelope.

37 Claims, 7 Drawing Sheets

Figure 4. Stroke tables for scratch type stab with peak pitch deviations of about -4 semitones (upper) and 13 semitones (lower).

Figure 5. Modified stroke table for a stab-forward stroke with a peak pitch deviation of 14.5 semitones.

APPARATUS AND METHOD FOR TRANSFORMING AN INPUT SOUND SIGNAL

CROSS-REFERENCE TO RELATED APPLICATIONS

This is a National Stage application of PCT/SG2007/000319, filed Sep. 19, 2007. The foregoing application is incorporated by reference herein in its entirety.

The invention relates to an apparatus and method for transforming an input sound signal. At least one of the disclosed techniques can be used for synthesising a scratched sound, such as a disc jockey (DJ) could produce.

In a basic DJ's setup, two turntables connect to a DJ mixer which pre-amplifies the turntable outputs and mixes them according to the position of a slide controller on the turntable crossfader. During a typical scratch, the DJ controls one turntable with one hand to change its playback rate and the crossfader with his other hand to fade in and out this turntable output. The remaining turntable usually plays some backing music.

Scratching is considered by many as the primary technique for playing the turntable as a musical instrument making "new" sounds from recorded sounds on vinyl records by altering the way they are played. The term "turntablism" is loosely defined as the act of performing on the turntable. Some consider turntablism to be a musical genre in its own right. Turntablists—that is, DJs who practice turntablism—change the rate of playing records with hand movements to produce scratched sounds. Many DJs play as expressively as any traditional instrumentalist, with control of the duration, loudness, articulation, and timbre of individual scratched sounds.

Turntablists produce different types of scratched sound with different scratching techniques; that is, the techniques implemented when the DJ moves the record on the turntable and/or the crossfader slide. The techniques for three fundamental types of scratches [1] are as follows:

- Stab: while moving the record in the forward (i.e. "normal) direction of play, the DJ fades the sound in and out;
- Reverse: the same as stab except that the record is moved in the reverse direction;
- Chirp: the DJ moves the record forward, fading the sound out; then the DJ moves the record in reverse, fading the sound in.

Recently DJing software has allowed DJs to extend their scratching techniques to manipulation of digital sound files. Broadly speaking, current DJing systems are able to generate time-varying rates of play back of sound files based on gestural data, graphical representations or stored patterns. Gestural—e.g. hand movement—data is captured by controllers such as control records (on ordinary turntables) [7], computer mice [4, 6], and optical sensors and accelerometers [3]. Graphical representations involve plotting changes in the playback rate over time [5].

Other systems store patterns of these changes for common scratching techniques [4, 6], and among them Skipproof allows limited modifications to the patterns [4]. However, it is possibly true to say that not even a proficient turntablist knows the exact changes in the playback rates for different scratches. This makes graphical representations of scratches not intuitive. Further, it makes synthesis/reproduction of scratches particularly difficult, especially for the unskilled DJ—i.e. DJs with minimal or no DJing/turntablist skills.

Further, there is no standard scratching notation. Though not in wide use, the Turntablist Transcription Methodology is a comprehensive grid system where changes in the playback position in the record are written [2]. An illustration of such notation is given in FIG. 1. With playback position on the Y-axis and time on the X-axis, a straight line with a gradient of two can be used to represent a scratch with twice the normal playback rate. Notational curves represent time-varying playback rates for scratches. This notation is aimed at communicating general musical ideas to human turntablists, but is not sufficiently precise for synthesis purpose.

Although gestural data preserves expressiveness, it is hard for musicians without DJing skills to execute the correct movements. Pattern-based systems such as those described above, do not require any DJing skills but in their current form these systems provide no means of allowing a DJ to create expressive turntablism performances.

Known techniques such as additive analysis/resynthesis are disclosed in, for example, [9]. Such known techniques as those typified by [9] use linear analysis which is particularly unsuitable for scratching techniques.

The invention is defined in the independent claims. Some optional features of the invention are defined in the dependent claims.

An apparatus incorporating the features of the independent claims may allow synthesis of scratched sounds by musicians, thereby enabling the musicians to describe scratches, scratch strokes and their acoustic characteristics in a musical, concise and reproducible notation. Such an apparatus is capable of producing a minimum of three types of scratches. With this repertoire, it is possible for musicians to create realistic and expressive performances. Further, the disclosed techniques allow users without a DJing skillbase to create realistic scratched sounds from and for music production, allowing creation of new sounds beyond simple stored patterns. In one implementation, the techniques may be used in a personalisable ringtone generator for mobile telephone ringtones.

The present invention will now be described, by way of example only, and with reference to the accompanying drawings in which.

Figure 1:
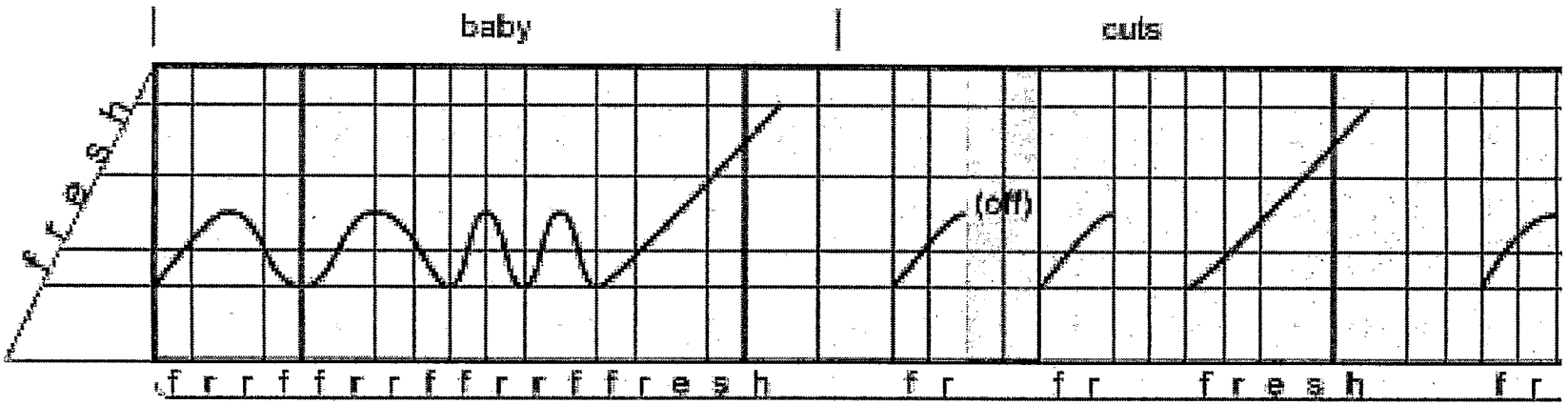
FIG. 1 is a notation chart illustrating the Turntablist Transcription Methodology.
Figure 2:
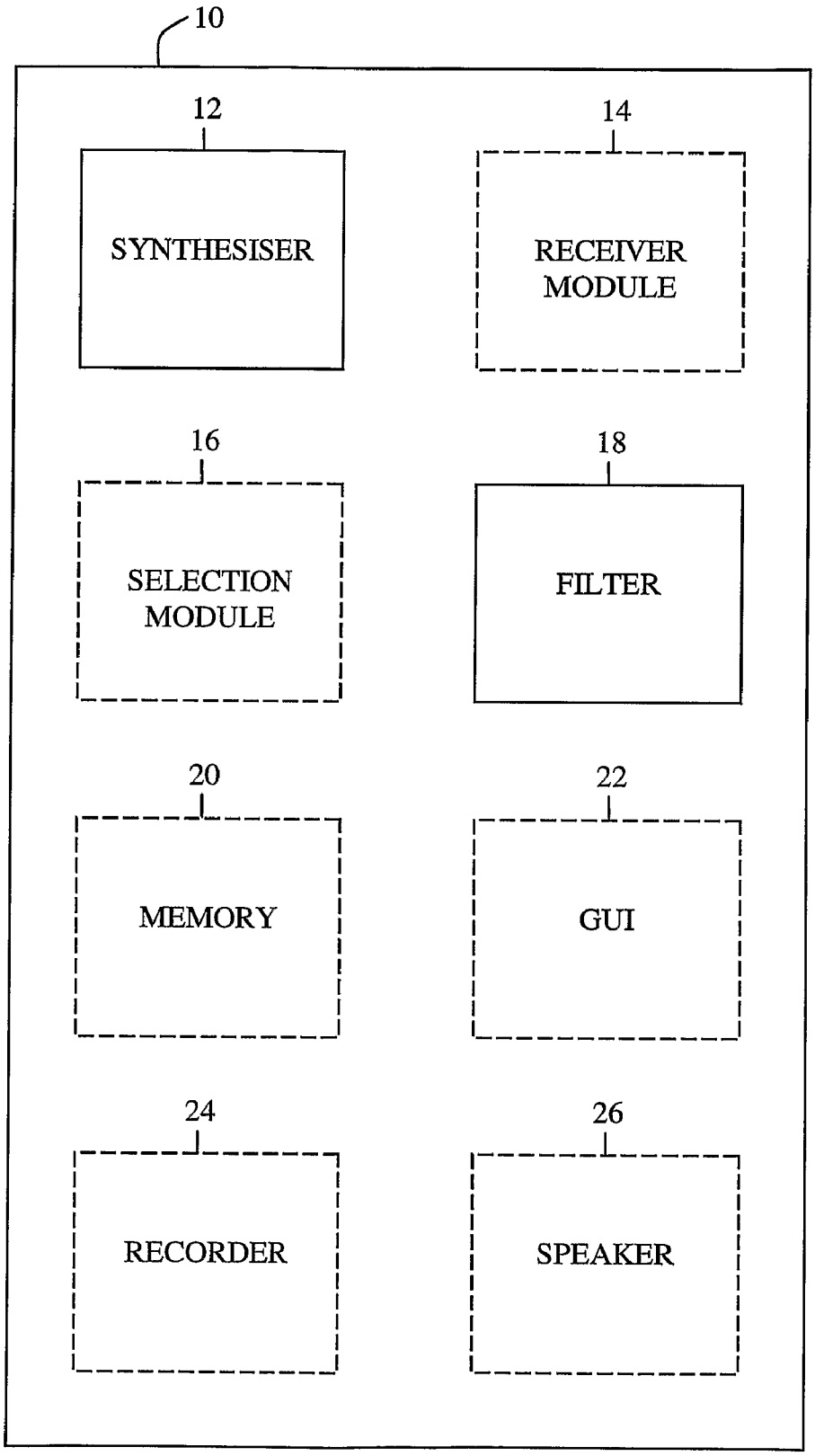
FIG. 2 is a block diagram illustrating an architecture of an apparatus for transforming an input sound signal.

An apparatus for transforming an input sound signal (usable to provide an output or "scratched" sound) is illustrated in FIG. 2. The apparatus 10 comprises principally a synthesiser 12 configured to manipulate, in accordance with a manipulation parameter, a pitch deviation envelope to derive a manipulated pitch deviation envelope; and a filter 18 configured to resample the input sound signal from a resampling of the input sound signal with respect to the manipulated pitch deviation envelope. These techniques will be discussed in more detail below. Optionally, the apparatus also comprises the following components:

- receiver module 14 configured to receive a user's choice of the manipulation parameter. This may be a user-defined peak pitch deviation of the output sound signal and/or defined in terms of duration and scratch type of the desired output sound;

selection module 16 configured to select the pitch deviation envelope from a plurality of pitch deviation envelopes. Therefore, manipulation of the pitch deviation envelope is a manipulation of the selected pitch deviation envelope selected by selection module 16. The selection module 16 selects the pitch deviation envelope with respect to the manipulation parameter;

memory 20 for, amongst other things, storing a pitch deviation envelope as a stroke table and a template input sound signal. The library of stroke tables is stored in memory 20;

a graphical user interface (GUI) 22 to allow a user to control the apparatus 10;

recording module 24 including, for example, a microphone and suitable processing circuitry (neither of which are illustrated) to allow a user to record one or both of an input sound signal to be transformed and a template sound signal for use in creating one or more pitch deviation envelopes in a library stored in memory 20; and speaker module 26 and suitable processing circuitry (not shown) for outputting an audible sound signal which is a transformed version of the input sound signal.

In one implementation the apparatus 10 is a computer apparatus which implements the disclosed techniques either in hardware, software or in a combination thereof. The apparatus may be configured to read, from a computer readable medium, executable code for implementing the disclosed techniques. In another example, the apparatus 10 is a mobile telephone apparatus where memory 20, GUI 22 (mobile telephone display and keypad), recorder module 24 (mobile telephone microphone and processing circuitry) and speaker 26 (mobile telephone earpiece and/or speaker and processing circuitry) are readily available standard mobile telephone features.

For the purposes of the following description, some definitions are now made:

a scratched sound comprises one or a sequence of stroke sounds;

a stroke corresponds to a hand movement in either a forward or backward direction;

a stroke sound is determined by at least a pitch deviation envelope and, optionally, an amplitude envelope;

a pitch deviation envelope is a signal envelope defining the pitch deviation of a stroke sound with respect to time;

an amplitude envelope is an envelope defining the signal amplitude of the stroke sound with respect to time;

the pitch deviation envelope may be specified by one or more of its peak pitch, its attack time (i.e. rise to the peak pitch) and decay time (i.e. it's decay from the peak pitch);

a stroke table is a table for storing parameters defining the pitch deviation envelope;

an output sound signal is a scratched sound which is a transformed input sound signal manipulated according to a user-defined parameter;

an input sound signal is a "scratchable unit"—that is, a sound signal to which the described techniques can be applied to produce a scratched sound;

a template input signal is a recorded sound which is used to derive pitch deviation envelopes for use in the scratching/transformation of the input signal.

A second apparatus (not shown) for transforming an input sound signal comprises a synthesiser for manipulating, in accordance with a manipulation parameter, a pitch deviation envelope selected with reference to the manipulation parameter to derive a manipulated pitch deviation envelope. The manipulation techniques of this apparatus may be as for synthesiser 12 of FIG. 2 described below. In this apparatus, the pitch deviation envelope may be selected by selection module 16 of FIG. 2 as described below.

Figure 3:
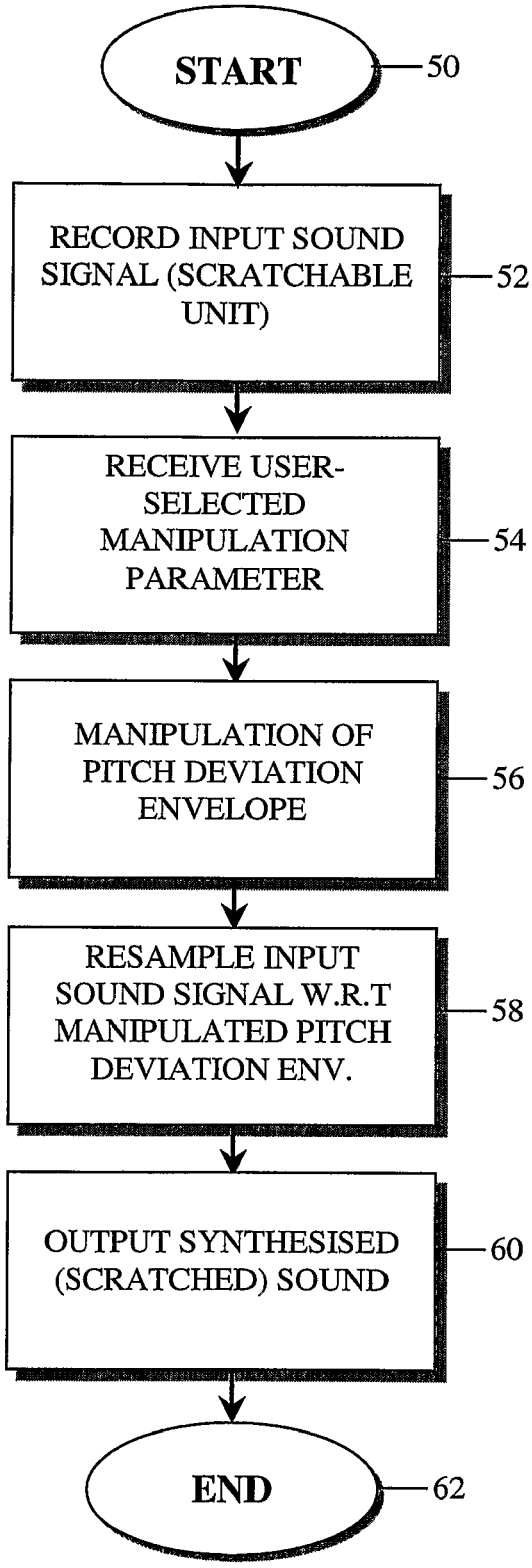
FIG. 3 is a process flow diagram illustrating a technique for transforming an input sound signal.

Referring now to FIG. 3, the process flow of a technique for transforming an input sound signal is described. The process begins at step 50. At step 52, an input sound signal (a scratchable unit) is recorded by the user using recorder module 24. The input sound signal is stored in memory 20.

At step 54, synthesiser 12 makes reference to a user-selected manipulation parameter. This may be received from the user at receiver module 14. The process is discussed in further detail below, but in one implementation, the manipulation parameter is a user-defined peak pitch deviation of an output sound signal defined by the user through GUI 22. That is, the user defines the desired peak pitch deviation of the output scratched sound.

At step 56, synthesiser 12 manipulates the pitch deviation envelope in accordance with the user-defined manipulation parameter, e.g. the desired peak pitch deviation of the output scratched sound.

At step 58, filter 18 resamples the input sound signal with respect to the manipulated pitch deviation envelope.

At step 60, the transformed input signal—i.e. the scratched sound—is output as the desired output sound signal by the apparatus 10 from speaker 26.

In one implementation, the manipulation at step 56 takes the form of a shift of the pitch deviation envelope in accordance with the peak pitch deviation of the (desired) output sound signal. That is the envelope of the pitch deviation envelope is shifted in accordance with the user-defined peak pitch deviation of the desired output sound signal. The shift corresponds to a peak pitch difference between a peak pitch of the pitch deviation envelope and a peak pitch deviation of the desired output sound signal. The pitch deviation envelope may comprise at least one of an attack portion and a decay portion, and the synthesiser is configured to stretch or trim the at least one of the attack portion and the decay portion when shifting the pitch deviation envelope. Signal processing algorithms for these operations are described in greater detail with respect to FIGS. 4 and 5.

Prior to its manipulation, the pitch deviation envelope is selected from a library of pitch deviation envelopes by synthesiser 12. The plurality of pitch deviation envelopes are defined by a respective plurality of stroke tables (discussed below) and synthesiser 12 makes the selection from a comparison of the user-defined peak pitch deviation of the output sound signal with respective peak pitch deviation values of the pitch deviation envelopes in the library.

As noted above, a scratched sound comprises one or a sequence of stroke sounds, each of which is determined by at least a pitch deviation envelope and, optionally, an amplitude envelope. Specifying the acoustic details of a number of strokes tends not to be intuitive and can also be tedious. A better representation would allow DJs and computer musicians alike to describe strokes (and scratches) on a musical level. It would also be concise and express main acoustic characteristics of the strokes.

From a technical perspective, scratching is the result of playing back a recording at a time-varying rate. The rate of playback is expressed as pitch deviation $\rho$. The higher the pitch deviation, the faster the recording plays. $\rho=1$ when the playback rate is normal, $\rho=2$ when it is twice the normal speed, and so on. If the recording is digital, the period (in number/amount of samples) between a time it is sampled and the time it is next sampled is equal to the value of ρ. Resampling of the digital signal allows for it to be reproduced at different playback rates. The value of ρ is equal to the original sampling rate divided by the new rate. The resampling process is described in greater detail below with respect to FIG. 7.

Taking into account a DJ's mental model of scratches and possible pitch deviation and amplitude envelopes for human performances, a stroke may be synthesised from the following parameters:

| Parameter | Name | Data type |
|---|---|---|
| Scratchable unit (time samples) | In | Array of 16-bit signed integer |
| Scratch name (e.g., "stab" "chirp", "reverse" and "letgo") | scratchName | Character string |
| Direction ("fwd" or "back") | Dir | Character string |
| Duration in seconds | Dur | Floating point number |
| Peak pitch deviation in semitones ([−24, 24]) | pitchDevPeak | Floating point number |
| Attack time of pitch deviation envelope in seconds | attackP | Floating point number |
| Attack time of amplitude envelope in seconds | attackA | Floating point number |
| Decay time of amplitude envelope in seconds | decayA | Floating point number |
| Initial playback position | playPos | Floating point number |

Receiver module 14 is configured to receive any one or more of the above parameters as the user-defined manipulation parameter for manipulation of the input sound signal by synthesiser 12.

A stroke corresponds to a hand movement in either a forward or backward direction. There can be silence between strokes, but each of the strokes is usually continuous. Playback of a scratched sound starts at its beginning, where the previous stroke ends, or at an arbitrary position. The peak pitch deviation of the stroke is related to the speed of the hand: the faster the hand, the higher the pitch. The attack and decay times of the stroke define the shapes of the pitch deviation and amplitude envelopes. For example, a simple stab scratch with one forward stroke is specified by a user as follows:

```
;        scratchName  in
scratch  Stab         "uh"   0 1 10000
;        Dir          dur    pitchDevPeak  attackP  attackA  decayA  playPos
stroke   Fwd          .052   14.5          .023     .01      .01     0 0
```

(The Lines Beginning with Semicolons are Comments.)

The first line of code is a scratch statement, and it begins the description of the stab scratch. The last line is a stroke statement, which specifies the acoustic parameters of an individual stroke. If a scratch includes several strokes, the DJ user may insert multiple stroke statements under the same scratch statement.

Figure 4:
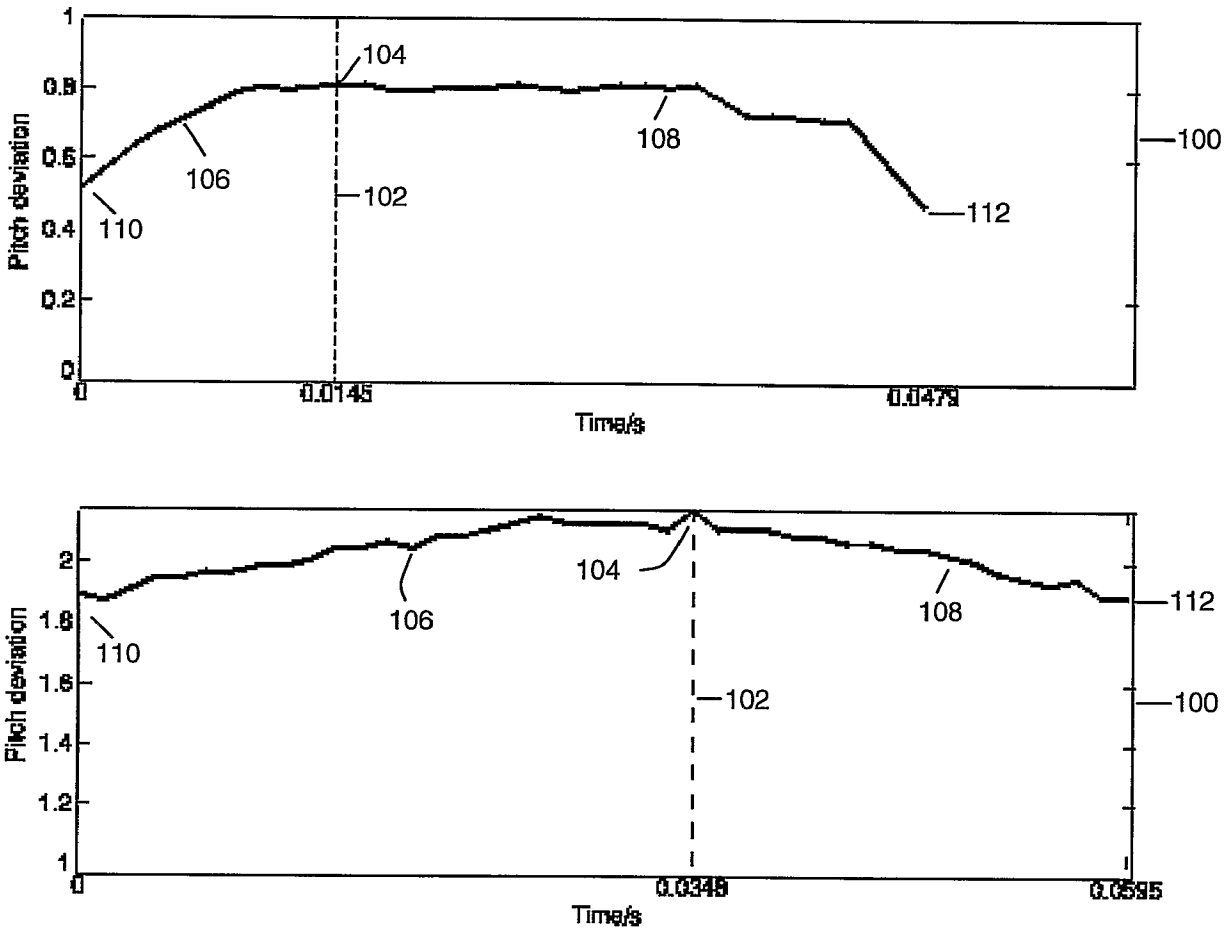
FIG. 4 illustrates stroke tables of pitch deviation envelopes.

Turning to FIG. 4, a first pair of pitch deviation envelopes 100 defining respective strokes are illustrated. The pitch deviation envelopes 100 are defined and stored as respective stroke tables. The full variation of timbre of the strokes is defined over the range from −24 to 24 semitones. The two illustrated pitch deviation envelopes are for scratch type stabs with respective peak pitch deviations of approximately −4 semitones and 13 semitones respectively. Dashed lines 102 divide the pitch deviation envelopes 100 into two sections: the attack portion 106 before the peak pitch deviation 104 and the decay portion 108 after the peak pitch deviation 104. Generally speaking, pitch deviation increases from a start point 110 through the attack portion 106 to the peak 104 and then decreases over decay portion 108 to end point 112. However, sometimes—and depending on the nature of the stroke—the pitch deviation envelope 100 does not comprise an attack portion 106, or a decay portion 108.

The upper pitch deviation envelope 100 of FIG. 4 is a pitch deviation envelope with a low pitch deviation corresponding to a slow stroke (that is, a slow hand movement). The pitch deviation changes rapidly in the beginning and at the end; that is, the gradient of the envelope at portions 106 and 108 is steep, increasing steeply at portion 106, and decreasing steeply at portion 108. Otherwise the gradient is sustained at about the peak deviation 104. On the other hand, the changes in pitch deviation during the fast stroke of the lower pitch deviation envelope of FIG. 4 (a stroke table with high pitch deviation) are gradual and continuous. The pitch deviation gradually increases over the relatively long attack of portion 106, and starts decreasing from point 104 to point 112 over portion 108.

It is these pitch deviation envelopes—stored as stroke tables—which are selected and manipulated with reference to the manipulation parameter discussed above to provide the manipulated pitch deviation envelope for use in resampling the input sound signal. The pitch deviation envelope 100 is manipulated/shifted according to the user's definition of the desired peak pitch deviation of the output sound signal.

That is, synthesiser 12 modifies the parameters of the stroke table for the specified scratch type and direction. Synthesiser 12 shifts the entire pitch deviation envelope 100 by the difference between the peak of the selected pitch deviation envelope and the peak of the specified output signal. The attack and decay sections 106, 108 of the envelopes 100 are trimmed/shortened if they are too long or stretched if too short.

Figure 5:
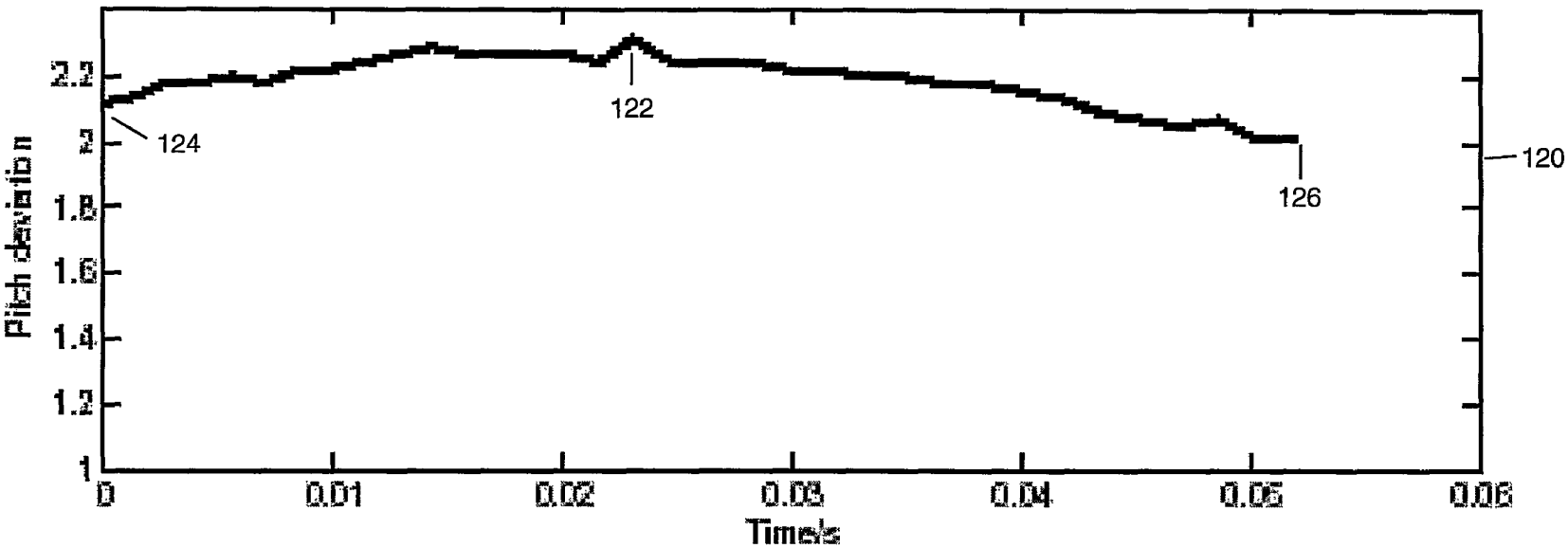
FIG. 5 illustrates a manipulated stroke table for a stab-forward stroke.

FIG. 5 illustrates a modified stroke table 120 for the stab scratch specified in the stroke table above. It is derived from the matched stroke table for a fast stroke, which has a peak pitch deviation 122 closest to the user-specified (in the stroke table) peak pitch deviation of 14.5. The pitch deviation envelope 120 is multiplied by a constant frequency ratio (equivalent to about 1.5 semitones). An initial portion of its attack has been trimmed off; that is, as the peak pitch has been shifted "left" on the time X-axis, the initial portion of the matched pitch deviation envelope was trimmed off, leaving a new start point 124 of the envelope 120. It is also possible to shorten the attack portion by squeezing/compressing it rather than trimming, but trimming gives a performance more in accordance with human perception. The entire decay portion 126 has been stretched to ensure the overall time of the pitch deviation envelope remains constant or at least substantially constant. Alternatively, it is possible to extrapolate the decay portion 126 but, again, it is found that stretching provides better performance. FIG. 5 thus illustrates a manipulated pitch deviation envelope for use in resampling of the input sound signal.

Figure 6:
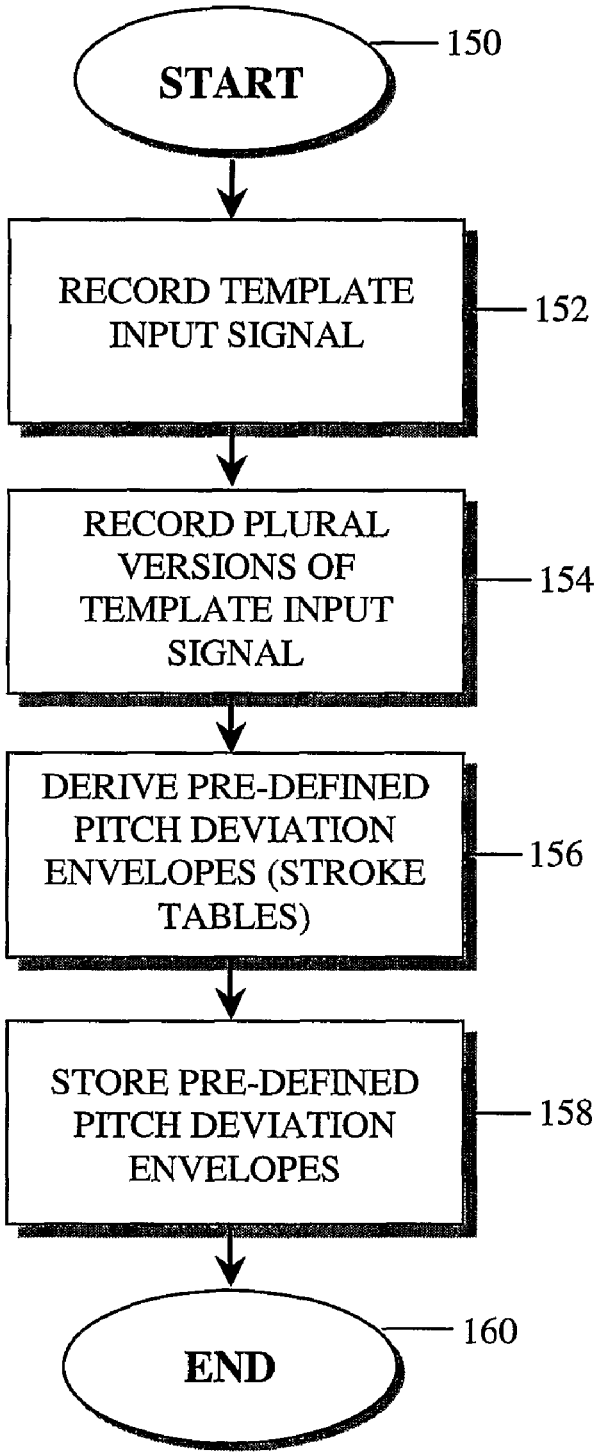
FIG. 6 is a block diagram illustrating the resampling process utilised in the playback of a manipulated stroke table.

Referring now to FIG. 6, an off-line process of a technique for deriving one or more pitch deviation envelopes suitable for use in the synthesis of a scratched sound and storing these in a library in memory 20 is now discussed. The process begins at step 150. At step 152, a template input signal is recorded by the user with recorder module 24 of apparatus 10. The sound may be any sound or speech signal as chosen by the user. For example, one might consider recording the sound of a user saying "aaaahhhh". At step 154, plural versions of the template input signal are recorded, each recorded with different speeds of playback of the template input signal. In one implementation of this, the sound "aaaahhhh" is recorded onto vinyl (i.e. a vinyl record), and the sound is scratched by a DJ using a turntable at various speeds/pitch deviation envelopes. These various recordings are recorded by module 24. From these recordings, the plural pitch deviation envelopes are derived for storing in memory 20.

Like acoustic musical instrument tones, scratched sounds in the same "register" have a similar timbre. It is possible to synthesise strokes of close peak pitch deviations and the same scratch type and direction using a stroke table. Several strokes may be recorded at different peak pitch deviations (usually 2-3 per octave) to allow variation in the timbre over the full range from −24 to 24 semitones.

One technique for deriving the plural pre-determined pitch deviation envelopes at step 156 comprises conducting a spectral analysis of the template input signal and one or more of the plural recordings of the template input signal (of time-varying speeds of playback). An alignment of the respective spectra is carried out and from this the pitch deviation envelopes are derived. The pitch deviation envelopes are stored in a library of stroke tables in, e.g., memory 20 at step 158. The process of FIG. 6 ends at step 160. The analysis/resynthesis process for the playback at step 60 of FIG. 3 of the synthesised sound signal is illustrated with respect to FIG. 7. The original scratchable unit 200 of FIG. 7 is an input sound signal as discussed above with respect to FIG. 3.

Figure 7:
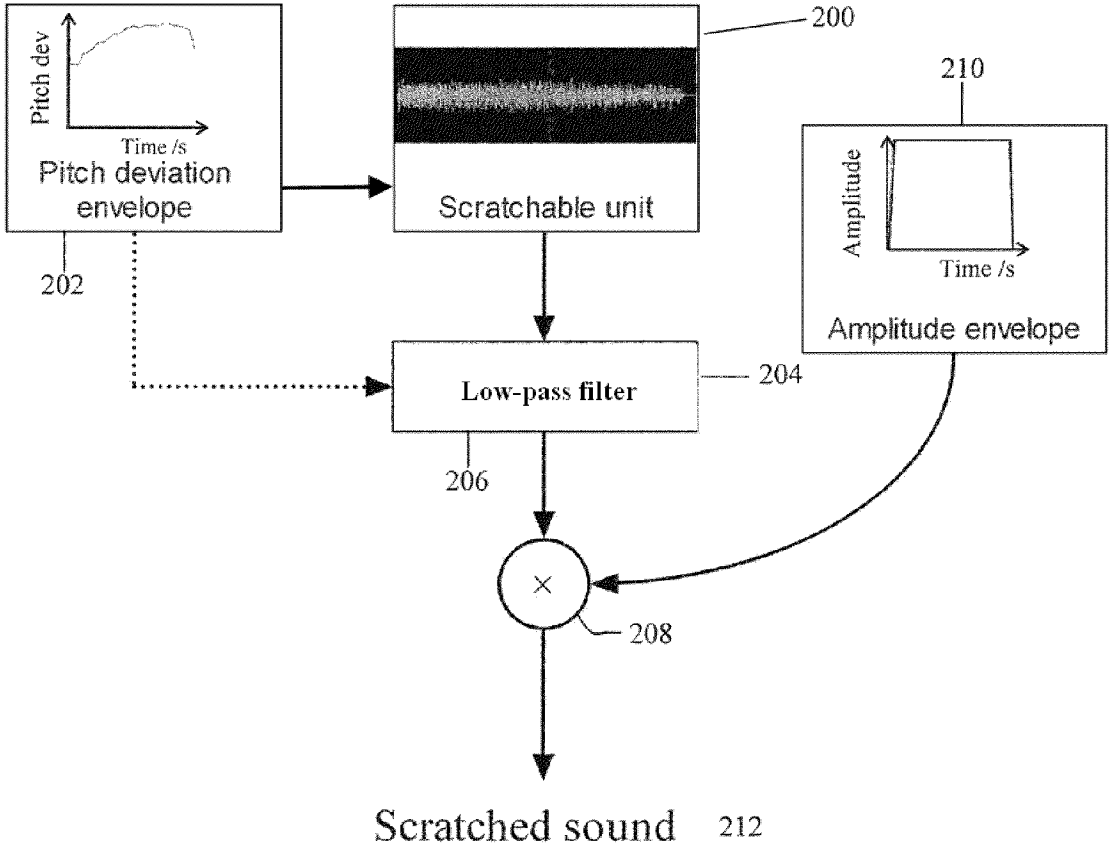
FIG. 7 is a process flow diagram illustrating a technique for deriving and storing pitch deviation envelopes suitable for use in the synthesising of a scratched sound.

FIG. 7 illustrates an overview of the resampling filter used for playback at a time-varying rate. The input sound signal (labelled "scratchable unit," 200) is resampled according to a pitch deviation envelope 202 by bandlimited interpolation [8] through a low-pass filter 204. Optionally, the scratched sound is scaled by multiplier 208 according to the amplitude envelope. In one implementation, simple ASD (attack, sustain, decay) envelopes are used approximations to the amplitude envelopes, and there is no need to store any parameters for the amplitude envelope(s). in such cases, the stroke tables define pitch deviation parameters only.

The low-pass filter has a cutoff frequency dependent on the pitch deviation, and a kaiser-windowed sinc kernel with stop-band attenuation of −80 dB. The output 206 of filter 204 is multiplied by multiplier 208 with an amplitude envelope 210, which is as long as the pitch deviation envelope. The scratched sound is then output (step 60 of FIG. 3) from speaker 26.

When a new sampling point falls between the original points, the new sample value can be obtained by the bandlimited interpolation technique. Based on Shannon's sampling theorem, bandlimited interpolation reconstructs missing sample values by convolving the original samples with the sinc function. The sinc function serves as the impulse response of a low-pass filter whose cutoff frequency is half of the lowest of the original and the new sampling rates.

In summary, the described scratched sound synthesiser allows synthesis of a sound clip for playback at different time-varying rates specified by a user to imitate the sounds a DJ produces on a turntable with different scratching techniques. The sound clip, called a scratchable unit, is usually speech with a single syllable. The scratched sound synthesiser turns the scratchable unit into a scratch with one or more strokes (e.g., a chirp scratch with a forward and a back strokes).

The invention has been described by way of example only and it will be appreciated that various modifications in detail may be made to the described embodiments above without departing from the spirit and scope of the claims. Features presented in one aspect of the invention may be combined with another aspect of the invention.

REFERENCES

[1] F. Broughton and B. Brewster, *How to DJ right: the art and science of playing records*. New York, N.Y.: Grove Press, 2003, pp. 184-195.

[2] J. Carluccio, E. Imboden, and R. Pirtle. (2006, Feb.) Turntablist transcription methodology. [Online]. Available: http://www.ttmethod.com/

[3] M. C. Hans and M. T. Smith, "Interacting with audio streams for entertainment and communication," in *Proc.* 2003 *ACM Multimedia*, Berkeley, Calif., 2003, pp. 539-545.

[4] K. F. Hansen and R. Bresin, "DJ scratching performance techniques: analysis and synthesis," in *Proc.* 2003 *Stockholm Music Acoust. Conf.*, Sweden, 2003, pp. 693-696.

[5] Image Line Software. (2007, May) FL Studio Wave Traveller. [Online]. Available: http://www.flstudio.com/help/html/plugins/Wave%20Traveller.htm

[6] Ots Labs Pty Ltd. (2007, May) Ots CD Scratch 1200. [Online]. Available: http://cdscratch.com/

[7] Rane Corp. (2007, May) Serato Scratch LIVE. [Online]. Available: http://www.rane.com/scratch.html

[8] J. O. Smith. (2006, Nov. 11) Digital audio resampling home page. resample.pdf. [Online]. Available: http://ccrma.stanford.edu/jos/resample/

[9] Roads et al., The Computer Music Tutorial (MIT press, Cambridge, Mass., 1995), pp. 144-156.)

The invention claimed is:

1. Apparatus for transforming an input sound signal to a scratched sound, the scratched sound comprising one or a sequence of stroke sounds, the apparatus comprising:

a synthesiser configured to, for each of said stroke sounds, select, with respect to at least one manipulation parameter, a pitch deviation envelope from a plurality of predetermined pitch deviation envelopes, defining respective possible stroke sounds, and manipulate, in accordance with said at least one manipulation parameter, said pitch deviation envelope to derive a manipulated pitch deviation envelope, the at least one manipulation parameter comprising musical and acoustic parameters; and a filter configured to transform the input sound signal from a resampling of the input sound signal with respect to the manipulated pitch deviation envelope.

2. Apparatus according to claim 1, further comprising a receiver module configured to receive the at least one manipulation parameter as a user-defined peak pitch deviation of an output sound signal.

3. Apparatus according to claim 2, wherein the synthesiser is configured to select the pitch deviation envelope from a comparison of the peak pitch deviation of the output sound signal with respective peak pitch deviation values of a plurality of predetermined pitch deviation envelopes.

4. Apparatus according to claim 1, wherein the synthesiser is configured to derive the manipulated pitch deviation envelope by shifting the pitch deviation envelope in accordance with the peak pitch deviation of the output sound signal.

5. Apparatus according to claim 4, wherein the synthesiser is configured to shift the pitch deviation envelope by a peak pitch difference between a peak pitch of the pitch deviation envelope and the peak pitch deviation of the output sound signal.

6. Apparatus according to claim 4, wherein the manipulated pitch deviation envelope comprises at least one of an attack portion and a decay portion, the synthesiser being configured to stretch or trim the at least one of the attack portion and decay portion when shifting the pitch deviation envelope.

7. Apparatus according to claim 1, wherein the synthesiser is configured to define the pitch deviation envelope as a stroke table for storing in a memory.

8. Apparatus according to claim 7, wherein the synthesiser is configured to define the stroke table with parameters defining an amplitude envelope.

9. Apparatus according to claim 7, wherein the synthesiser is configured to approximate parameters defining an amplitude envelope.

10. Apparatus according to claim 1, further comprising a receiver module configured to receive the at least one manipulation parameter as a peak pitch deviation and optionally, one or more selected from the group consisting of: scratchable unit; scratch name; stroke duration; pitch deviation envelope attack time; amplitude envelope attack time; amplitude envelope decay time; stroke initial playback position.

11. Apparatus according to claim 1, further comprising a recording module for recording a plurality of predetermined pitch deviation envelopes and a memory module for storing the plurality of predetermined pitch deviation envelopes.

12. Apparatus according to claim 1, further comprising a receiver module configured to receive the at least one manipulation parameter as a stroke direction.

13. Apparatus for transforming an input sound signal to a scratched sound, the scratched sound comprising one or a sequence of stroke sounds, the apparatus comprising a synthesiser configured to for each of said stroke sounds, manipulate, in accordance with at least one manipulation parameter, a pitch deviation envelope selected from a plurality of predetermined pitch deviation envelopes defining respective possible stroke sounds and selected with reference to the at least one manipulation parameter to derive a manipulated pitch deviation envelope, the at least one manipulation parameter comprising musical and acoustic parameters.

14. Apparatus according to claim 13, further comprising a recording module for recording a plurality of predetermined pitch deviation envelopes and a memory module for storing the plurality of predetermined pitch deviation envelopes.

15. Apparatus according to claim 13, further comprising a receiver module configured to receive the at least one manipulation parameter as a stroke direction.

16. A method for transforming an input sound signal to a scratched sound, the scratched sound comprising one or a sequence of stroke sounds, the method comprising:

for each of said stroke sounds, selecting, with respect to at least one manipulation parameter, a pitch deviation envelope from a plurality of predetermined pitch deviation envelopes defining respective possible stroke sounds;

manipulating, in accordance with said at least one manipulation parameter, said pitch deviation envelope to derive a manipulated pitch deviation envelope, the at least one manipulation parameter comprising musical and acoustic parameters; and transforming the input sound signal from a resampling of the input sound signal with respect to the manipulated pitch deviation envelope.

17. The method of claim 16, further comprising receiving the at least one manipulation parameter as a user-defined peak pitch deviation of an output sound signal.

18. The method of claim 17, wherein the selection of the pitch deviation envelope is effected from a comparison of the peak pitch deviation of the output sound signal with respective peak pitch deviation values of a plurality of pre-determined pitch deviation envelopes.

19. The method of claim 16, wherein derivation of the manipulated pitch deviation envelope is effected by shifting the pitch deviation envelope in accordance with the peak pitch deviation of the output sound signal.

20. The method of claim 19, wherein shifting of the pitch deviation envelope is by a peak pitch difference between a peak pitch of the pitch deviation envelope and the peak pitch deviation of the output sound signal.

21. The method of claim 19, wherein the manipulated pitch deviation envelope comprises at least one of an attack portion and a decay portion, and the method comprises stretching or trimming the at least one of the attack portion and decay portion when shifting the pitch deviation envelope.

22. The method of claim 16, further comprising defining the pitch deviation envelope as a stroke table for storing in a memory.

23. The method of claim 22, further comprising defining the stroke table with parameters defining an amplitude envelope.

24. The method of claim 22, further comprising approximating parameters defining an amplitude envelope.

25. The method of claim 16, further comprising receiving the at least one manipulation parameter as a peak pitch deviation and optionally, one or more selected from the group consisting of: scratchable unit; scratch name; stroke direction; pitch deviation envelope attack time; amplitude envelope attack time; amplitude envelope decay time; stroke initial playback position.

26. The method of claim 16, further comprising recording a plurality of predetermined pitch deviation envelopes and storing the plurality of predetermined pitch deviation envelopes.

27. The method of claim 16, further comprising receiving the at least one manipulation parameter as a stroke direction.

28. A method for transforming an input sound signal to a scratched sound, the scratched sound comprising one or a sequence of stroke sounds, the method comprising, for each of said stroke sounds, manipulating, in accordance with at least one manipulation parameter, a pitch deviation envelope selected from a plurality of predetermined pitch deviation envelopes defining respective possible stroke sounds and selected with reference to the at least one manipulation parameter to derive a manipulated pitch deviation envelope, the at least one manipulation parameter comprising musical and acoustic parameters.

29. The method of claim 28, further comprising recording a plurality of predetermined pitch deviation envelopes and storing the plurality of predetermined pitch deviation envelopes.

30. The method of claim 28, further comprising receiving the at least one manipulation parameter as a stroke direction.

31. A method of defining a scratched sound by its acoustic characteristics, the scratched sound comprising one or a sequence of stroke sounds, the method comprising, for each of said stroke sounds, defining the acoustic characteristics using at least one manipulated pitch deviation envelope, the manipulated pitch deviation envelope derived from manipulating, in accordance with at least one manipulation parameter, a pitch deviation envelope selected from a plurality of predetermined pitch deviation envelopes defining respective possible stroke sounds and selected with reference to the at least one manipulation parameter.

32. A method of claim 31 further comprising defining the acoustic characteristics using at least one amplitude envelope.

33. A method of claim 31 wherein the at least one of the deviation envelopes define one or more musical and acoustic parameters of the stroke sound.

34. The method of claim 33, wherein the musical and acoustic parameters of the stroke sound comprises a stroke direction.

35. A method of claim 33 wherein the musical and acoustic parameters of the stroke sound comprises a peak pitch deviation and optionally, one or more selected from the group consisting of: scratchable unit; scratch name; stroke duration; pitch deviation envelope attack time; amplitude envelope attack time; amplitude envelope decay time; stroke initial playback position.

36. A method of transforming an input sound signal by applying a scratched sound, the scratched sound being as defined by claim 31, the method comprising:

for each of said stroke sounds, selecting, with respect to one or more musical and acoustic parameters, one or more pitch deviation envelopes of the stroke sound from a plurality of predetermined pitch deviation envelopes;

manipulating said one or more pitch deviation envelopes of the stroke sound, in accordance with said one or more musical and acoustic parameters, to derive one or more manipulated pitch deviation envelopes; and transforming the input sound signal by resampling the input sound signal with respect to the one or more manipulated pitch deviation envelopes.

37. The method of claim 31, further comprising recording a plurality of predetermined pitch deviation envelopes and storing the plurality of predetermined pitch deviation envelopes.

* * * * *